US007194776B1

(12) United States Patent
Lastuka et al.

(10) Patent No.: US 7,194,776 B1
(45) Date of Patent: Mar. 27, 2007

(54) LIQUID STREAM ANALYSIS AND FEEDBACK SYSTEM WITH ACOUSTIC FILTERING METHOD

(76) Inventors: Sean Michael Lastuka, 15402 Sallsbury La., Huntington Beach, CA (US) 92647; Christopher Stephen Payne, #80 5019 46 Ave. S.W., Calgary, Alberta (CA) T3E 6R1

( * ) Notice: Subject to any disclaimer, the term of this patent is extended or adjusted under 35 U.S.C. 154(b) by 114 days.

(21) Appl. No.: 11/110,599

(22) Filed: Apr. 19, 2005

(51) Int. Cl.
*A47K 17/00* (2006.01)
*E03C 1/00* (2006.01)
*G08B 21/00* (2006.01)

(52) U.S. Cl. ..... 4/661; 4/902; 340/603; 340/691.6; 340/692

(58) Field of Classification Search ..... 4/661, 4/902, 302, DIG. 3; 340/692, 603–605, 340/609, 691.6
See application file for complete search history.

(56) References Cited

U.S. PATENT DOCUMENTS 5,125,621 A * 6/1992 Parsons et al. ..... 251/30.3
6,028,520 A * 2/2000 Maehre ..... 340/692
6,098,211 A 8/2000 Ehrensperger et al.
6,293,516 B1 * 9/2001 Parsons et al. ..... 251/129.04
6,513,173 B1 2/2003 Sykes
6,723,929 B2 4/2004 Kent
6,772,454 B1 8/2004 Barry et al.
6,779,206 B1 8/2004 Sykes

OTHER PUBLICATIONS

Dan Maynes-Aminzade, "You're in Control: A Urinary User Interface", http://web.media.mit.edu/%7Ehayes/ma8803/urinecontrol.html, 2002.
"Good Vibrations", Economist, Dec. 2, 2004, p. 10 Technology Quarterly, Economist Group.
James Brook, "Japanese Masters Get Closer to Toilet Nirvana", NY Times, Oct. 8, 2002, New York, NY.

* cited by examiner

*Primary Examiner*—Tuan Nguyen

(57) ABSTRACT

A facility for the purpose of entertainment, education, or monitoring wherein there is provided an acoustic sensor (24) mounted on the outside of a toilet bowl (30) and a simple, inexpensive target (22) mounted to the inside of the toilet (28) thereby keeping the sensitive acoustic sensor and other electronics in a dryer and cleaner location. The sound of a urine stream contacting the target (22) propagates through the toilet (26) and is detected by the acoustic sensor (24). An analysis and feedback unit (32) monitors the sound of the urine stream contacting the target (22) and provides a message to the user indicating their success in hitting the target (22) with the urine stream.

20 Claims, 15 Drawing Sheets

LIQUID STREAM ANALYSIS AND FEEDBACK SYSTEM WITH ACOUSTIC FILTERING METHOD

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

Figure 1:
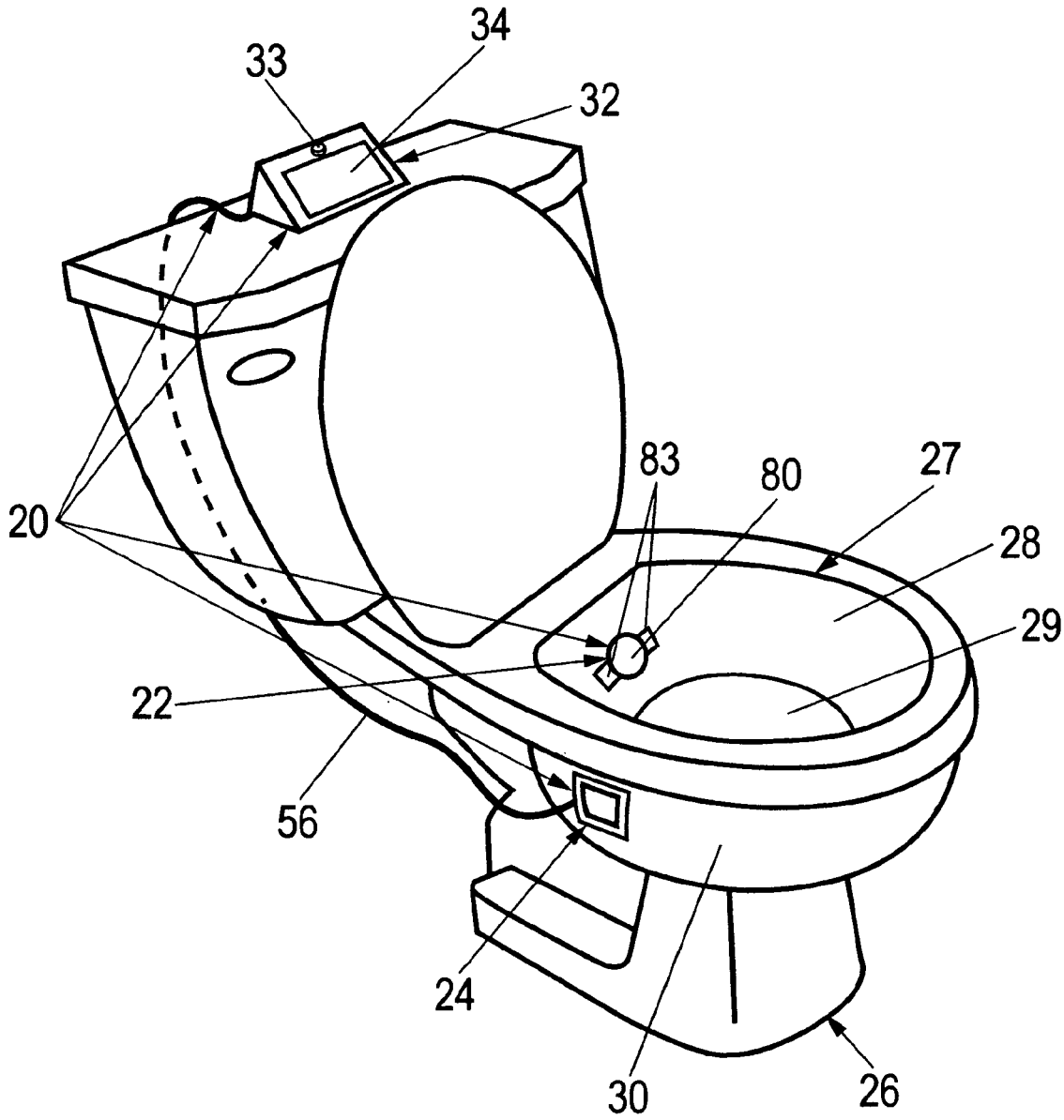

This invention relates to a method of sensing a stream of urine or liquid upon a toilet, urinal surface or other liquid impacted surface and providing feedback relating to the accuracy, duration and intensity of the liquid stream for the purpose of monitoring, analysis, or entertainment.

2. Prior Art

Previously, prior art in this field included numerous inventions that allow a user to aim a stream of urine at a target in a toilet and register a score. U.S. Pat. No. 6,779,206 (2004) proposes a sensor in the toilet bowl or a sensor requiring installation of a protective shield in the toilet bowl. Complex electronics within the bowl are problematic because they are heavy and require a strong adhesive to affix to the bowl. Additionally, electronics in the bowl need robust and watertight housings that are expensive to replace when they fail due to exposure over time. Furthermore, the electronics will require a battery which, when out of energy, will involve an unhygienic removal and replacement operation considering its placement in a dirty toilet bowl.

Alternately, simple targets can be within the bowl but require a cumbersome wire or a set of wires leading into the bowl for signal transmission and power supply purposes. U.S. Pat. No. 6,772,454 (2004) shows an embodiment with a set of electronic devices in the toilet and a wire leading to a controller display outside the toilet. Such an embodiment would lead to the difficult-to-clean wire and the previously mentioned need for robust housing to protect sensitive electronics.

U.S. Pat. No. 6,098,211 (2000) uses audio analysis to detect the sound of the flushing toilet and trigger cleaning. It stops short of integrating such technology into a urine sensing entertainment system.

U.S. Pat. No. 6,723,929 (2004) uses audio analysis to determine when the toilet should flush and how much water should be used to flush it. It also stops short of integrating such technology into a urine sensing entertainment system.

BACKGROUND OF INVENTION—OBJECTS AND ADVANTAGES

Accordingly, several objects and advantages of our invention are derived by placing the urine sensor outside the bowl. Within the bowl is a simple and light target, constructed so that, when impacted by urine, it creates a different sound than the sound of urine impact on the inner toilet wall surface. There are no complex electronics within the toilet bowl, and only a microphone need be mounted on the outer surface of the toilet bowl to capture the sound of urine impact. Both the target and the sensor will be light enough to adhere to the toilet surface with minimal adhesive. No power supply will be required in the toilet bowl or outside of the bowl. Also, there will be no need for drilling or cutting of the toilet surface to install the system. This system can be installed on urinals or toilets with the target located on the area where the urine impacts and the sensor located on the outer side of the urinal or toilet.

Cleaning of the target and sensor can be carried out with the thoroughness normally afforded to the bowl of the toilet. Strong adhesives will hold the lightweight target and sensor to the toilet despite vigorous cleaning. Should, over time, either sensor housing or target fall off, replacement sensor housings and targets and can be replaced for a small fraction of the cost of the entire urine detection entertainment system.

Electronics to analyze the urine stream and provide feedback can be mounted in a location that is remote from the sensor. The preferred location for these electronics is in view of the user. The most likely locations are on top of the toilet tank or mounted to the wall behind the toilet. In these locations, there will be minimal need for cleaning and minimum exposure to moisture.

Audio analysis can be used to implement a game and not just cleaning or flushing, as proposed in earlier art.

SUMMARY

A urine sensor consisting of an acoustic sensor mounted on the exterior of a toilet and a target mounted on the interior wall of the toilet bowl. An electronic system senses the output of the acoustic sensor to determine if the urine stream is impacting the target or other areas of the toilet bowl. A display will provide positive feedback to the user if the target is impacted by urine.

DRAWINGS—FIGURES

FIG. 1—Perspective view of the preferred embodiment

Figure 2:
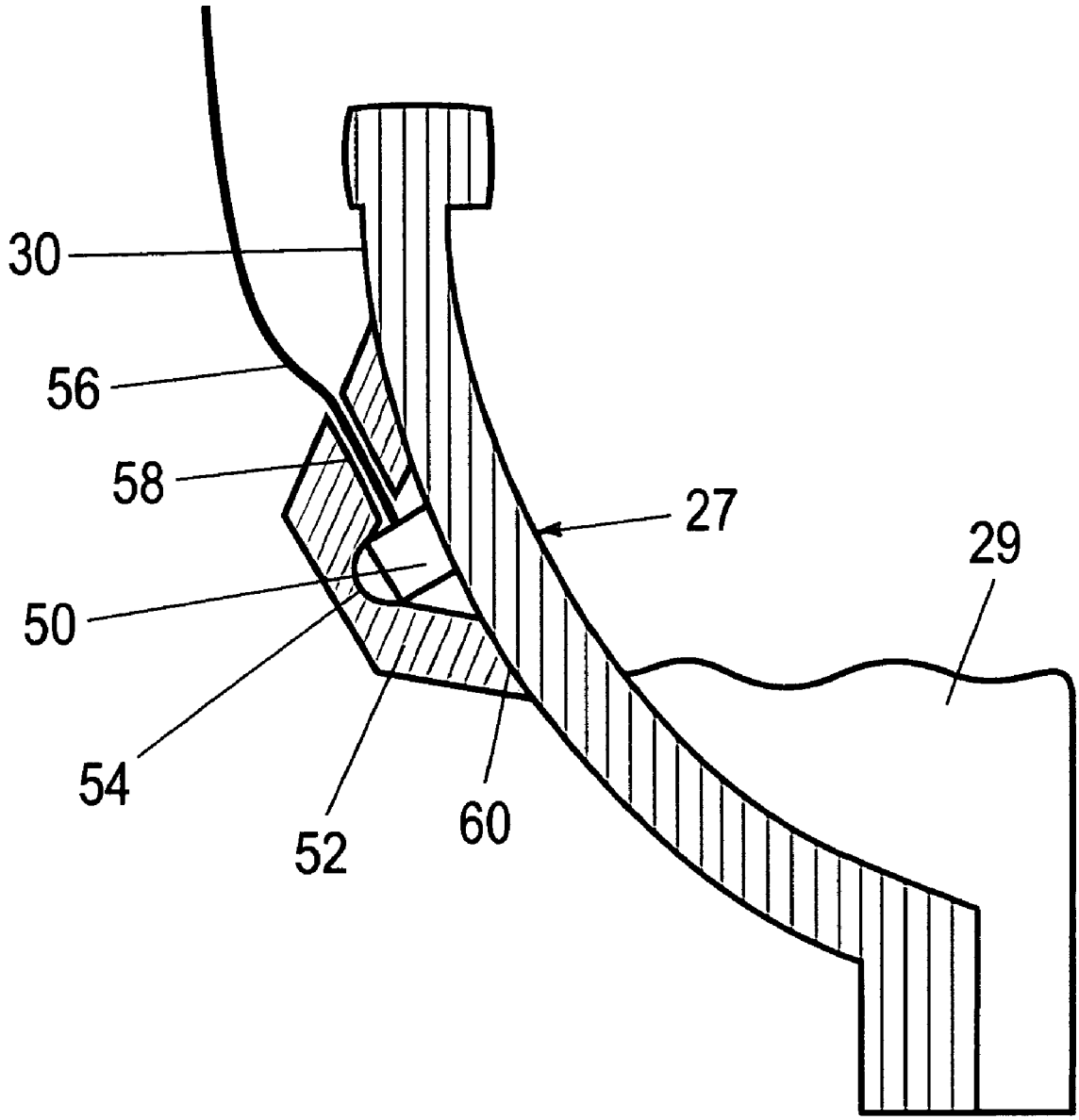

FIG. 2—Sectional view of the sensor assembly in the preferred embodiment

Figure 3:
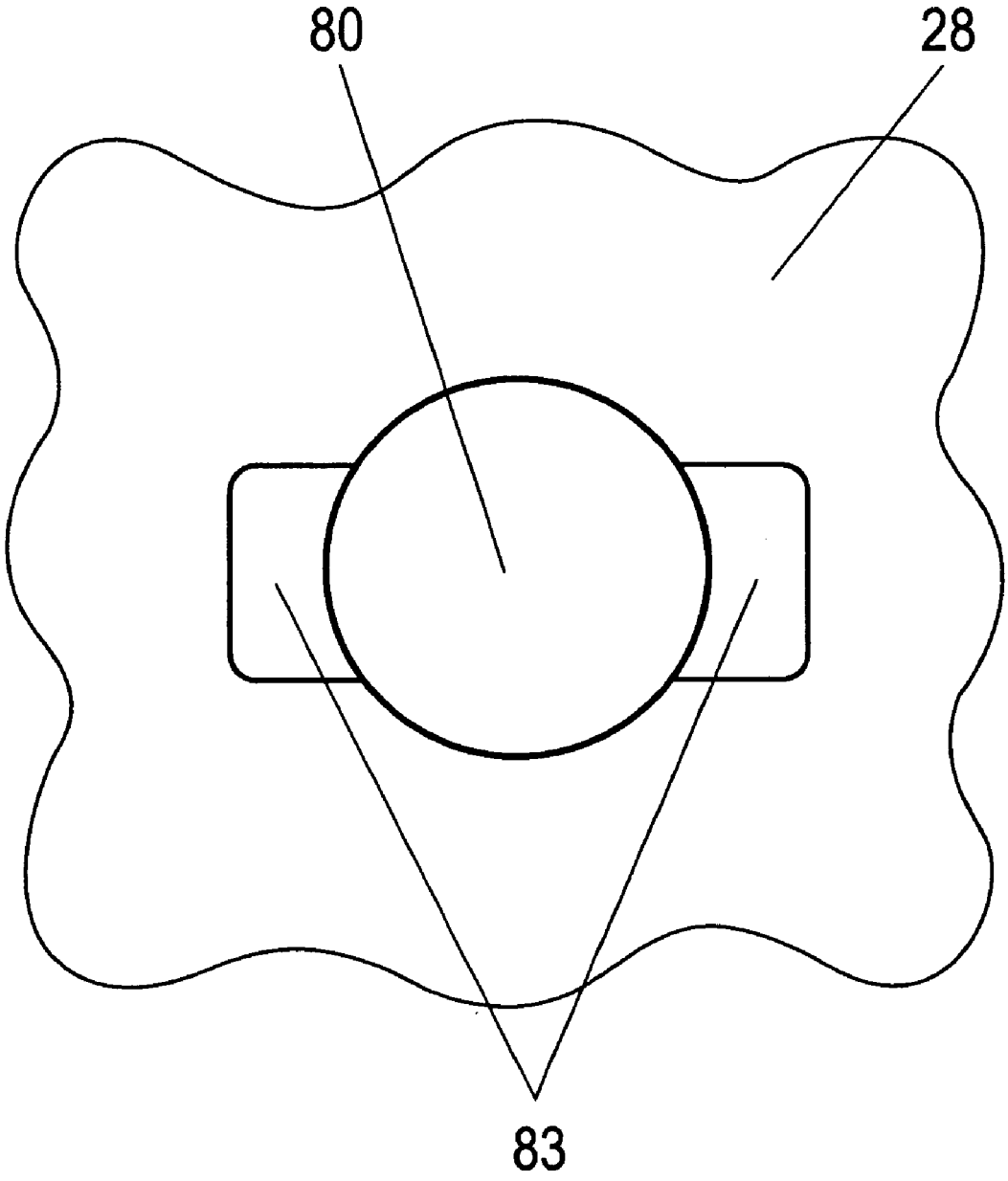

FIG. 3—Front view of the target in the preferred embodiment

Figure 4:
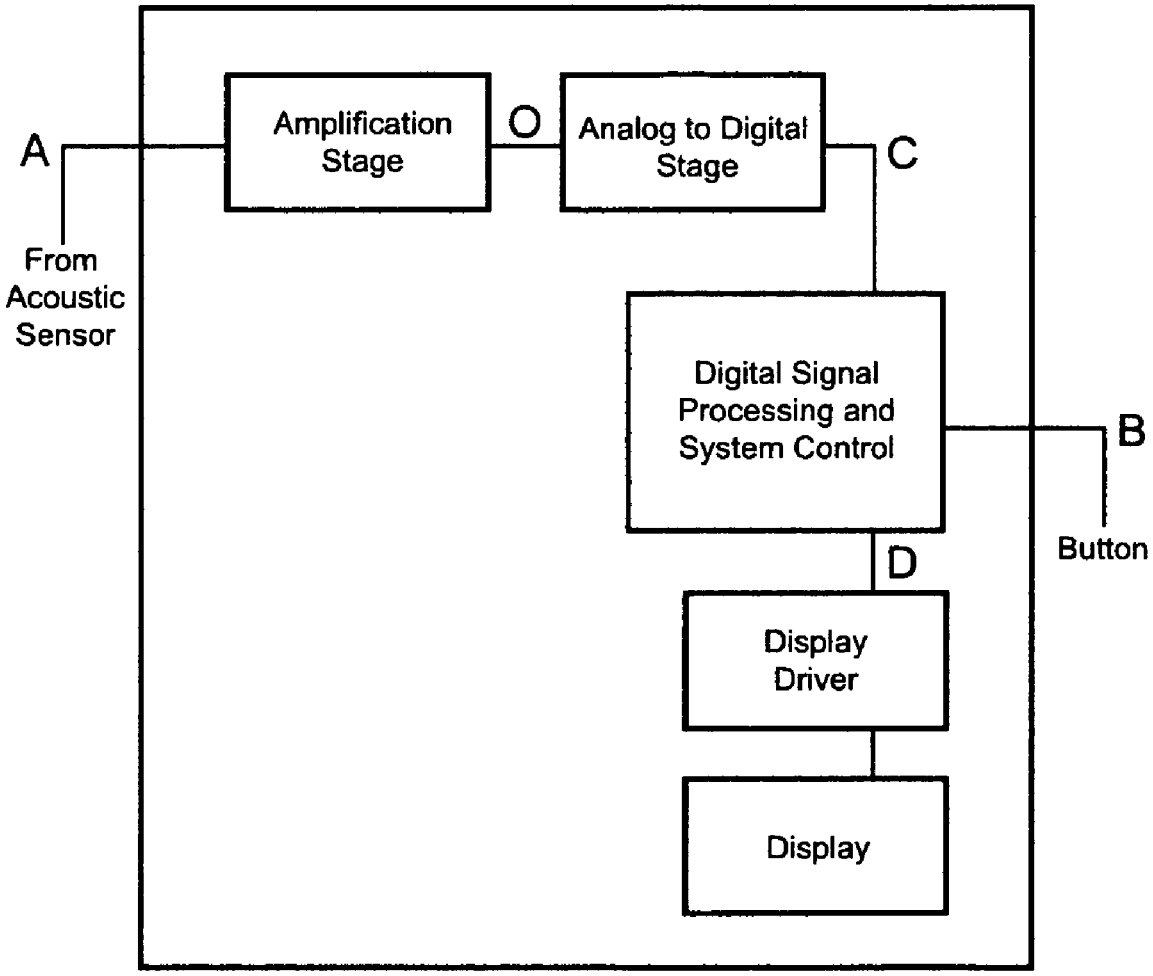
Figure 5:
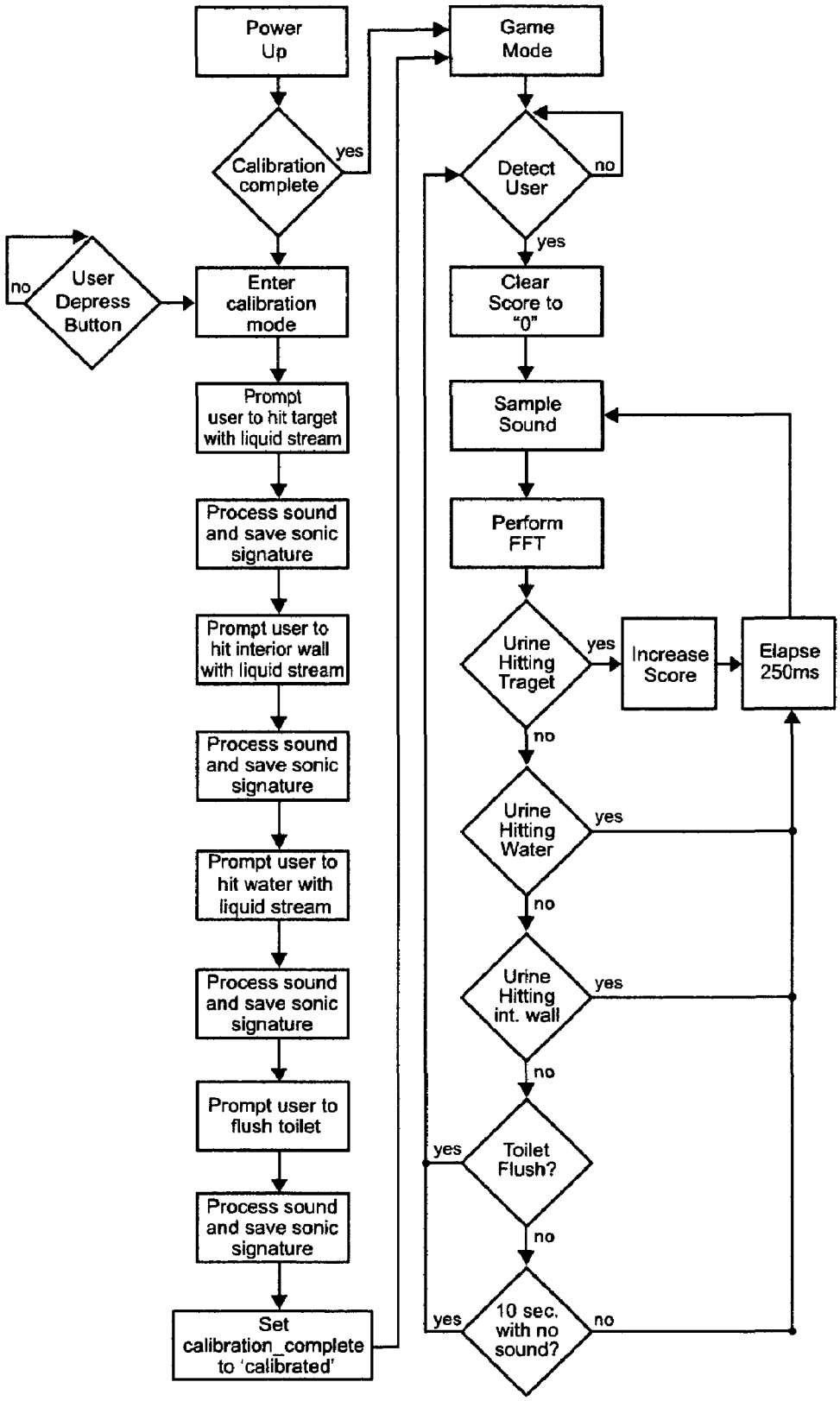
Figure 6:
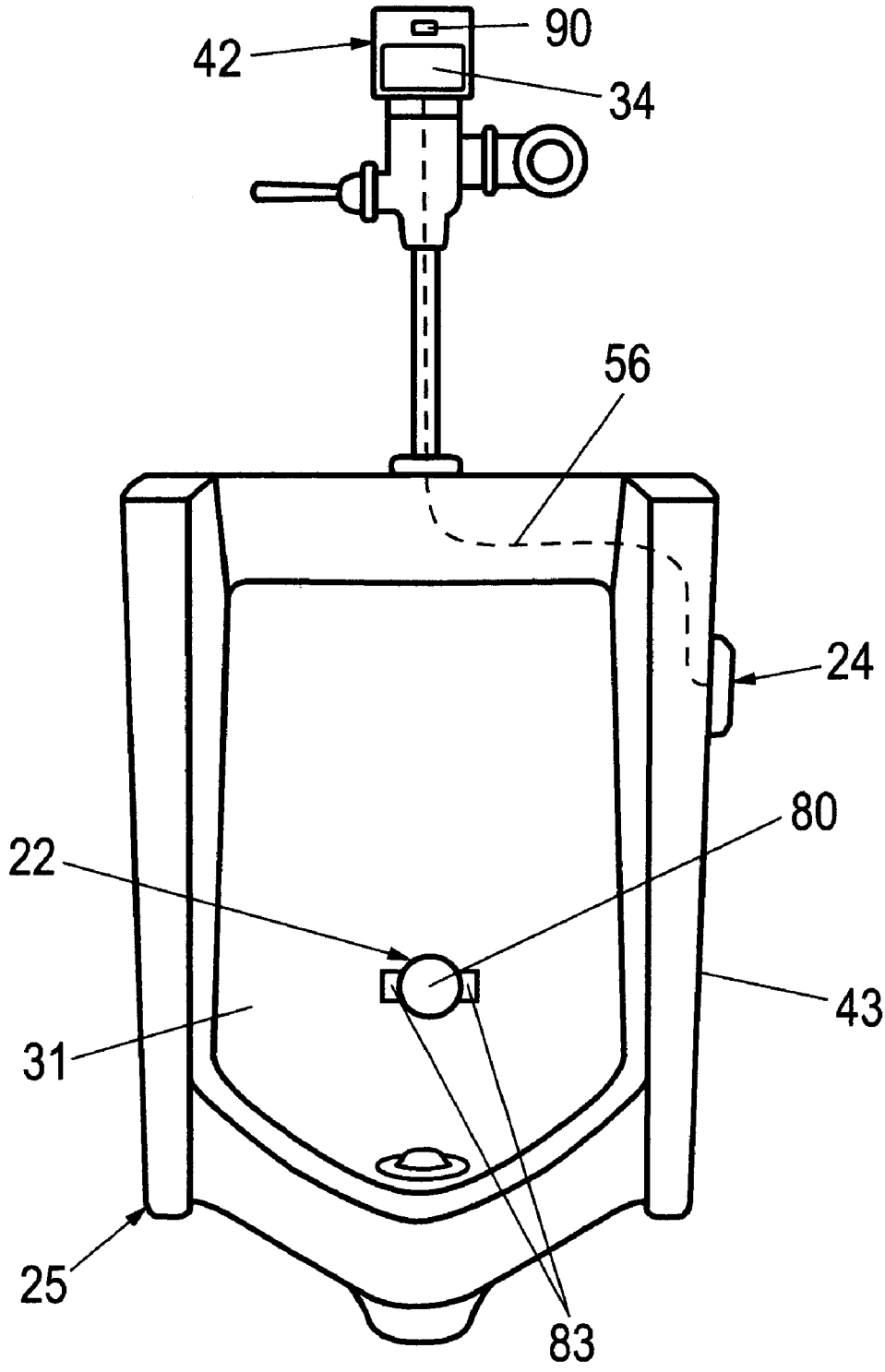
Figure 7:
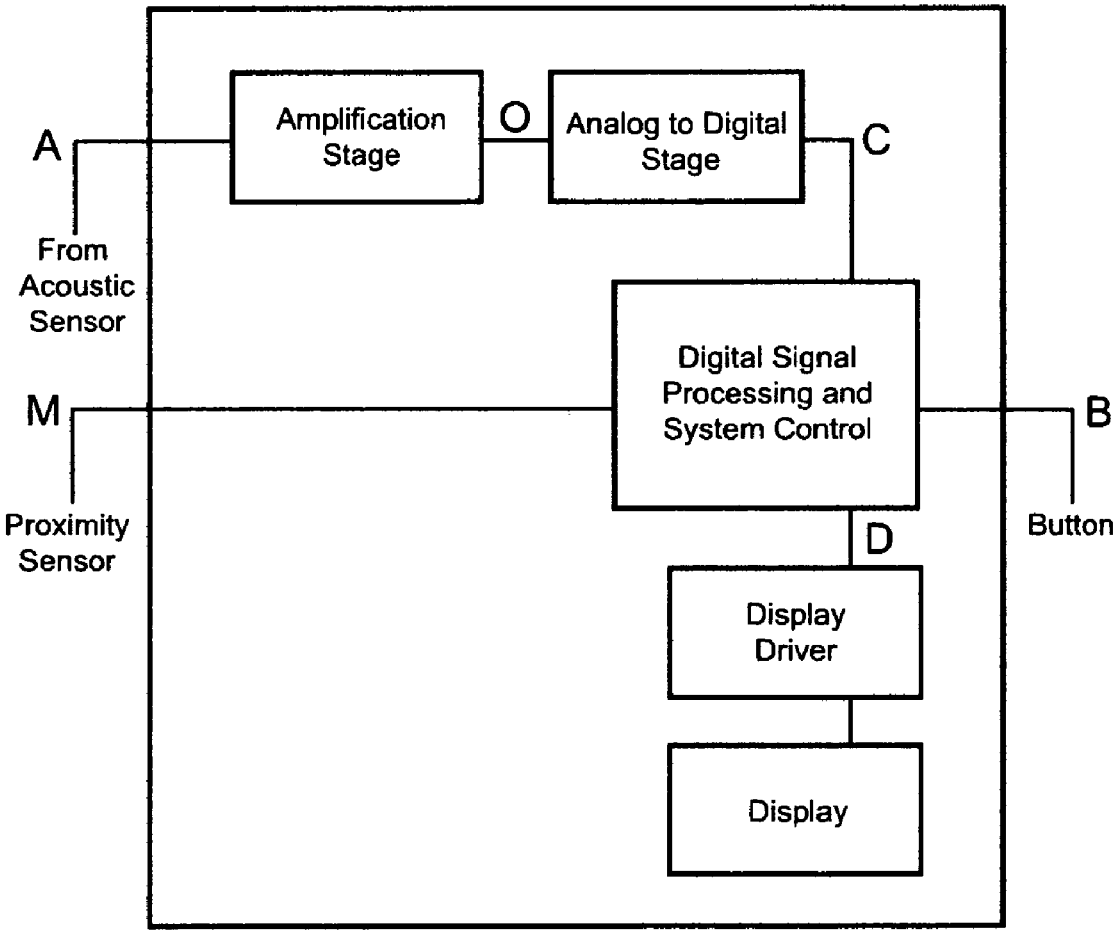
Figure 8:
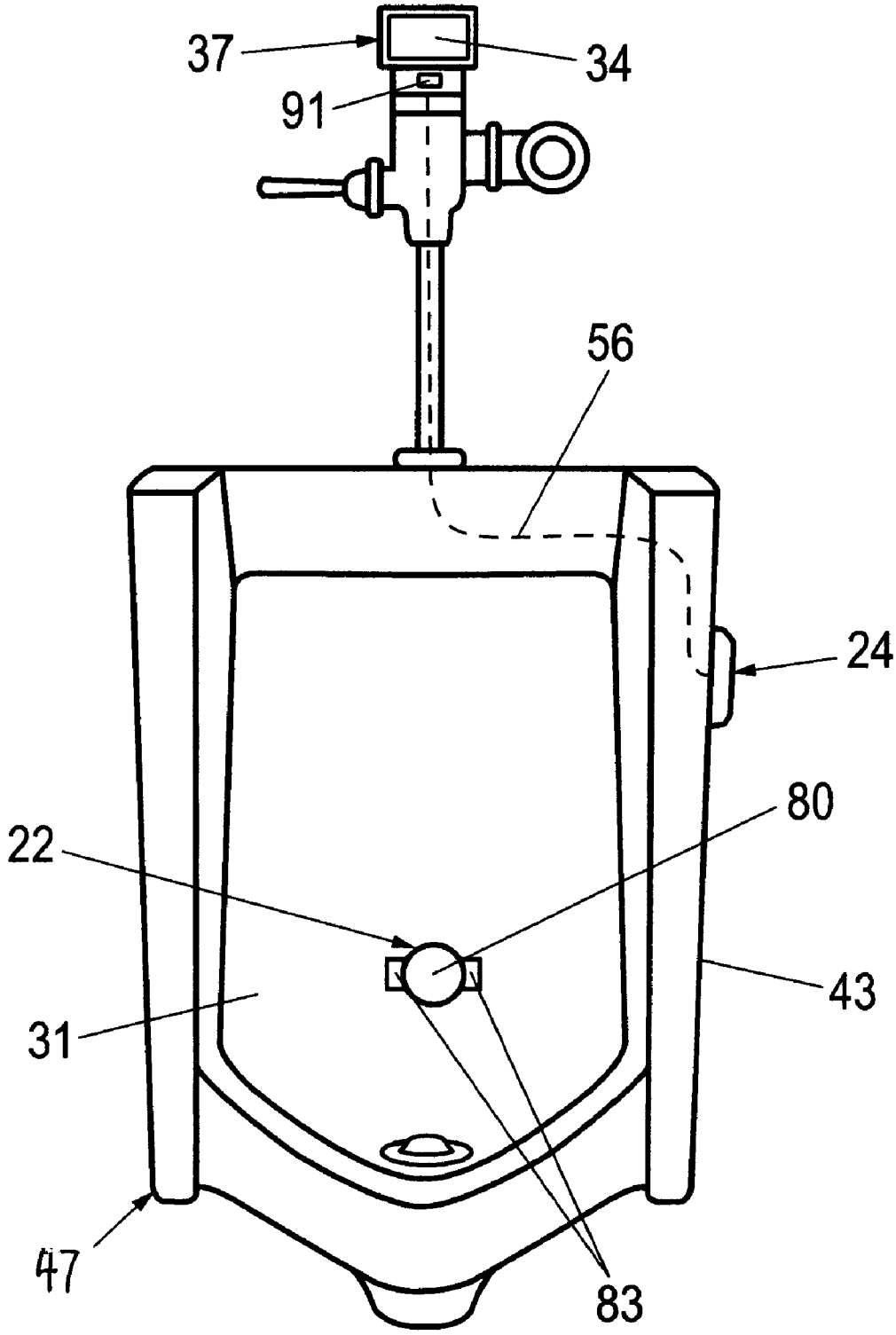
Figure 9:
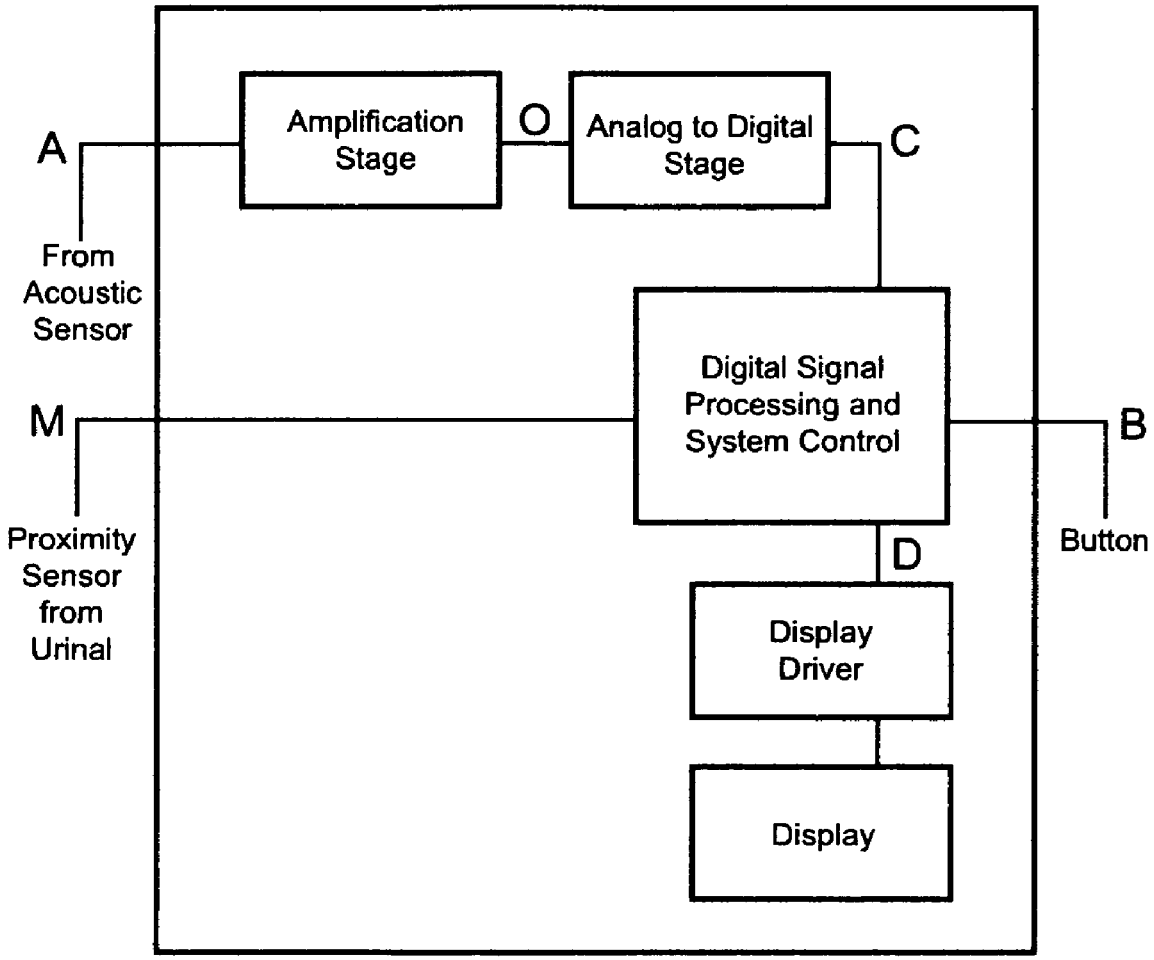
Figure 10:
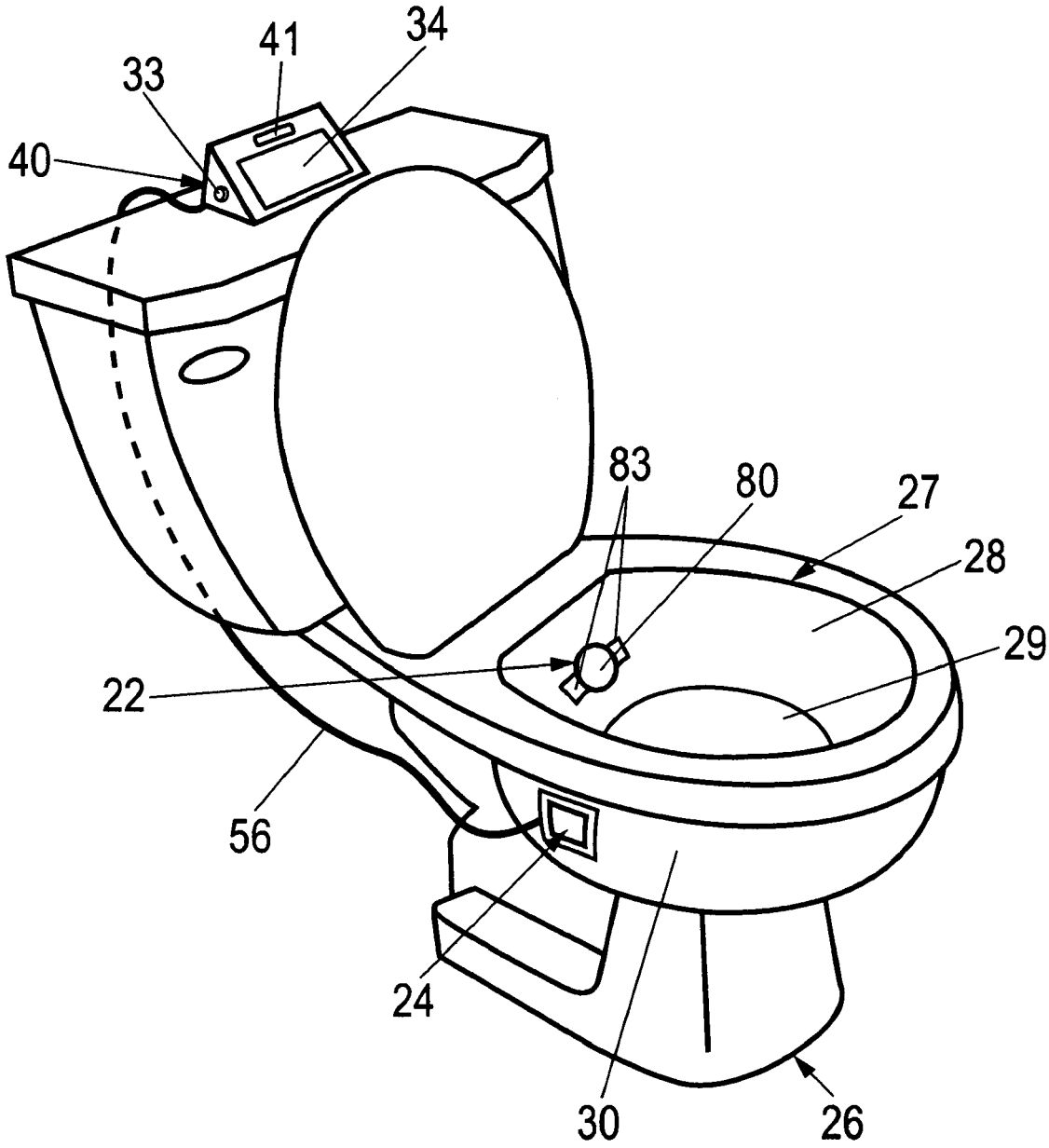
Figure 11:
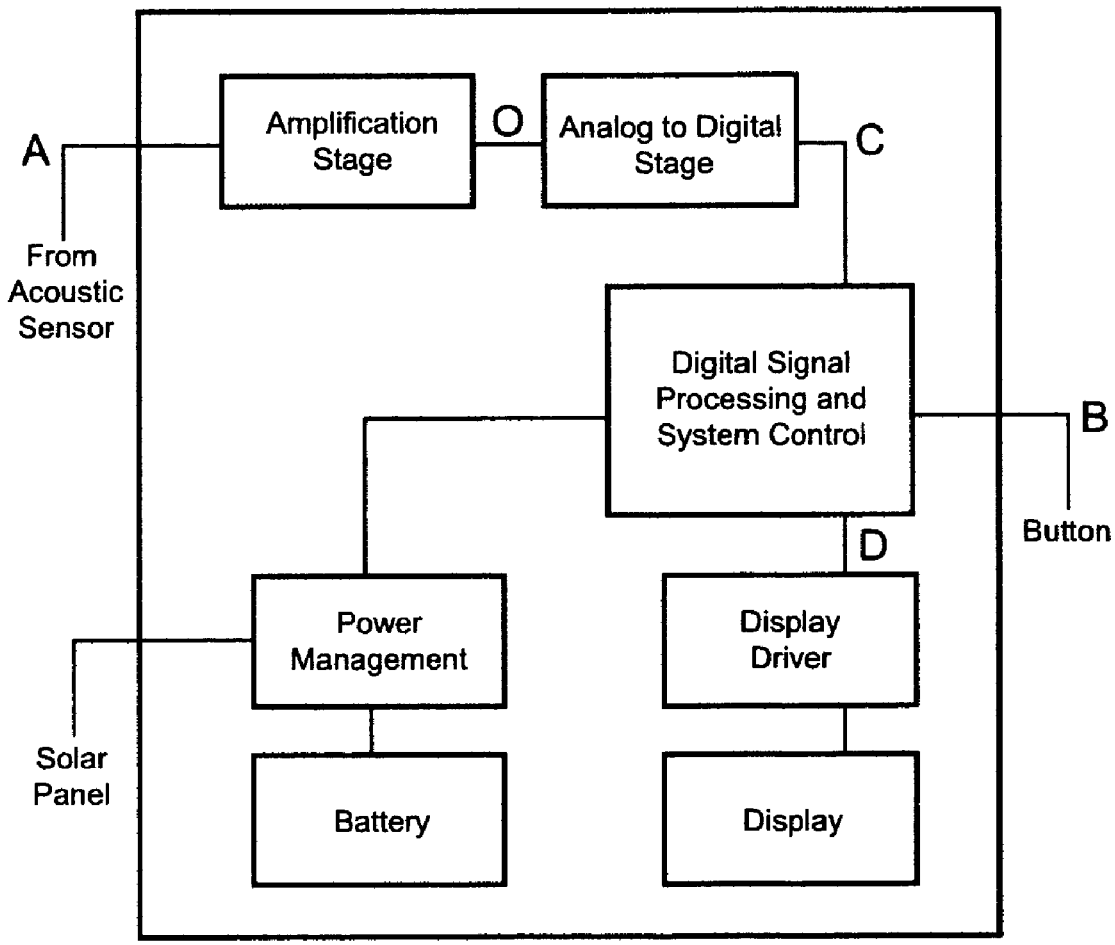
Figure 12:
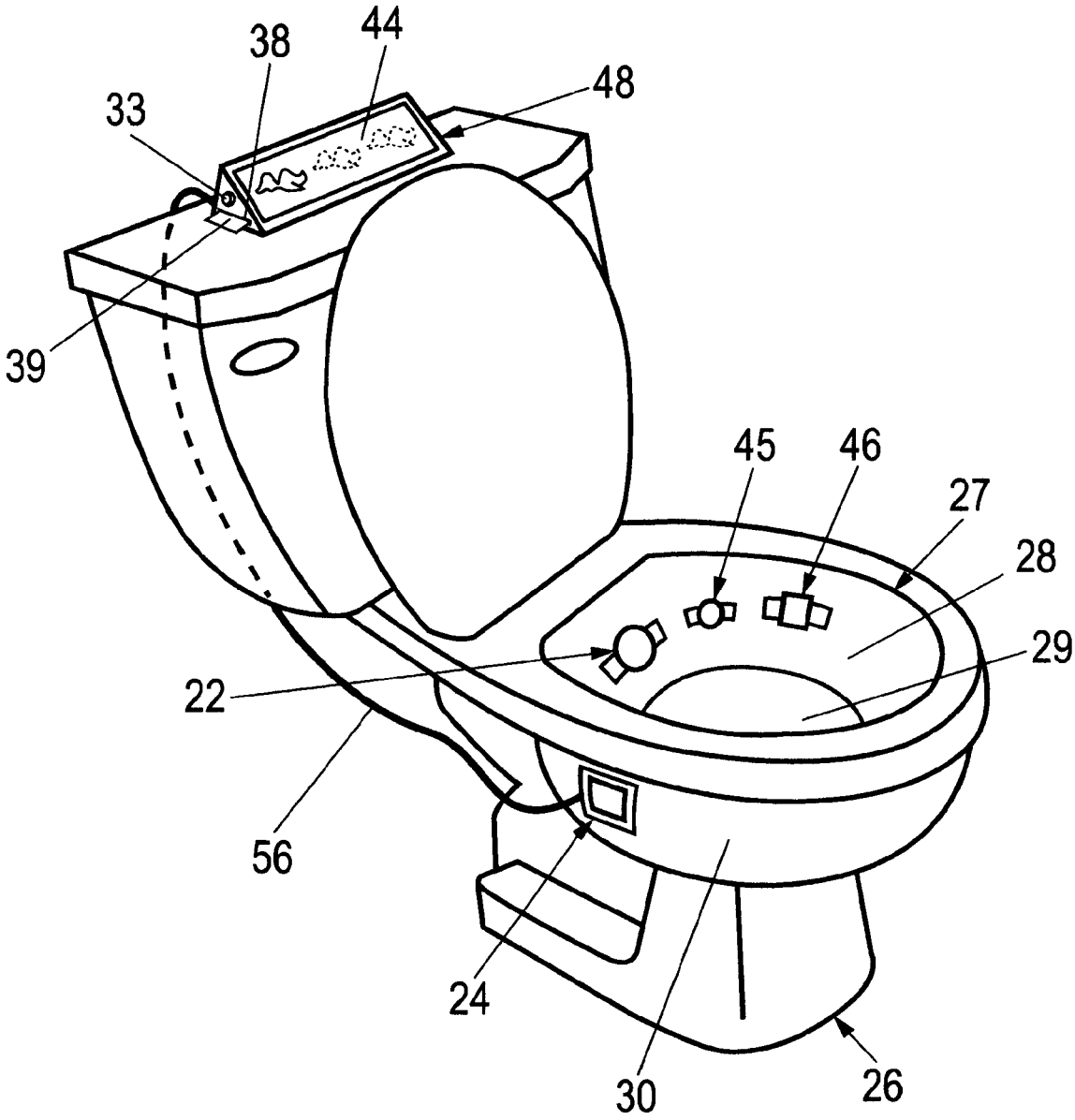
Figure 13:
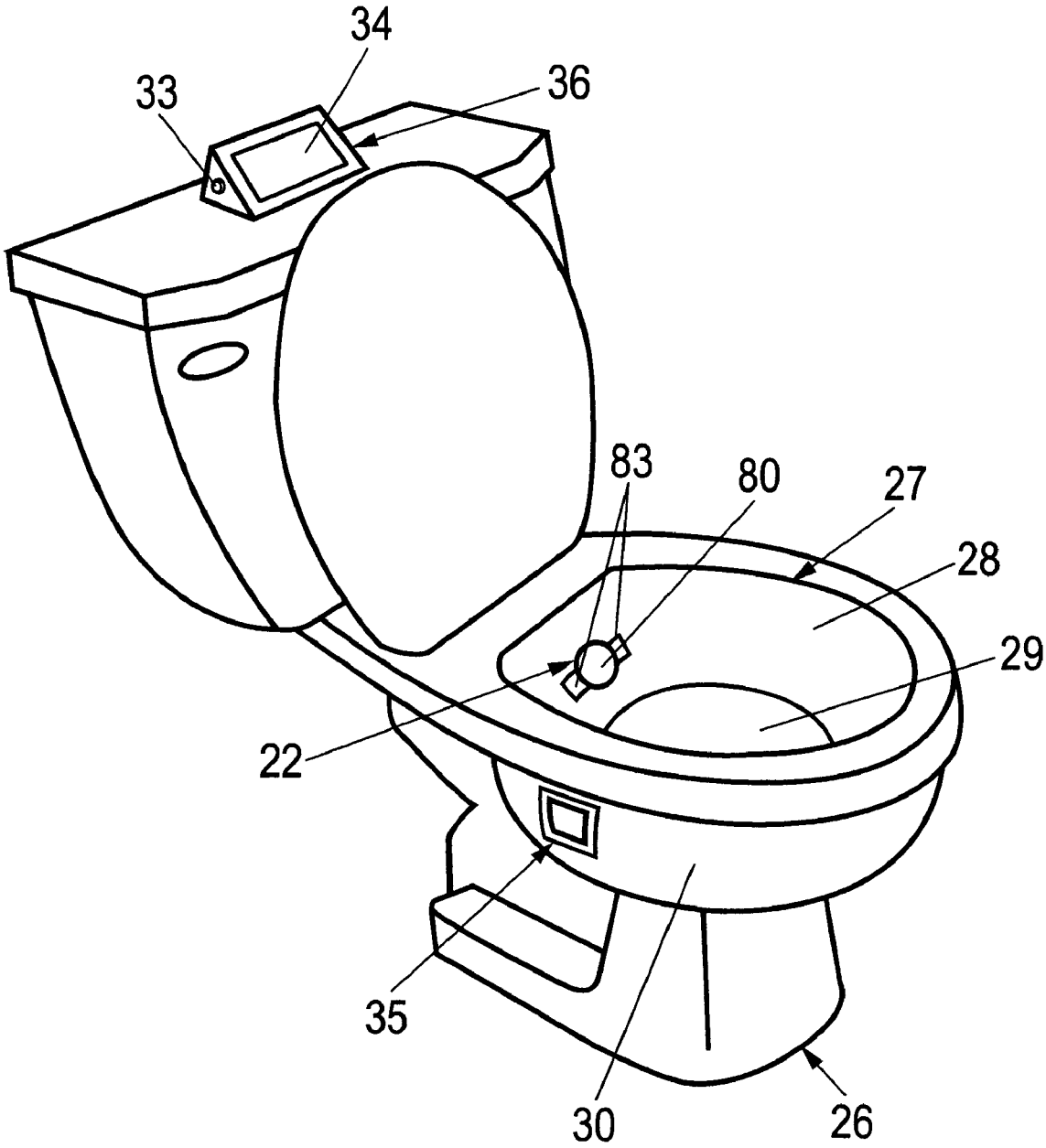
Figure 14:
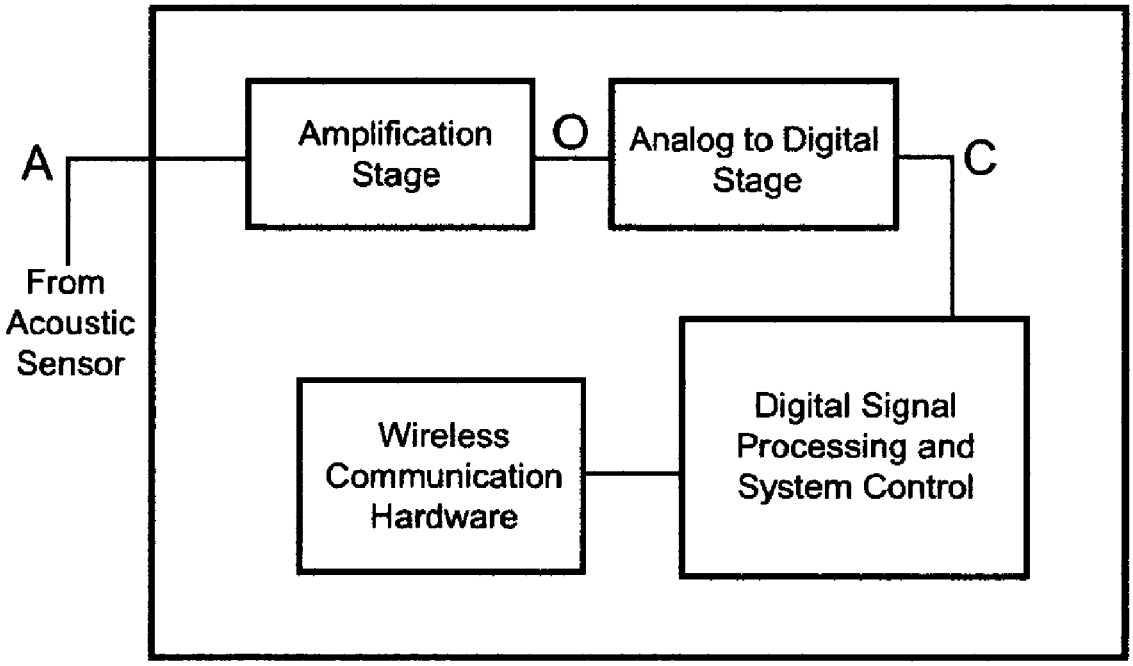
Figure 15:
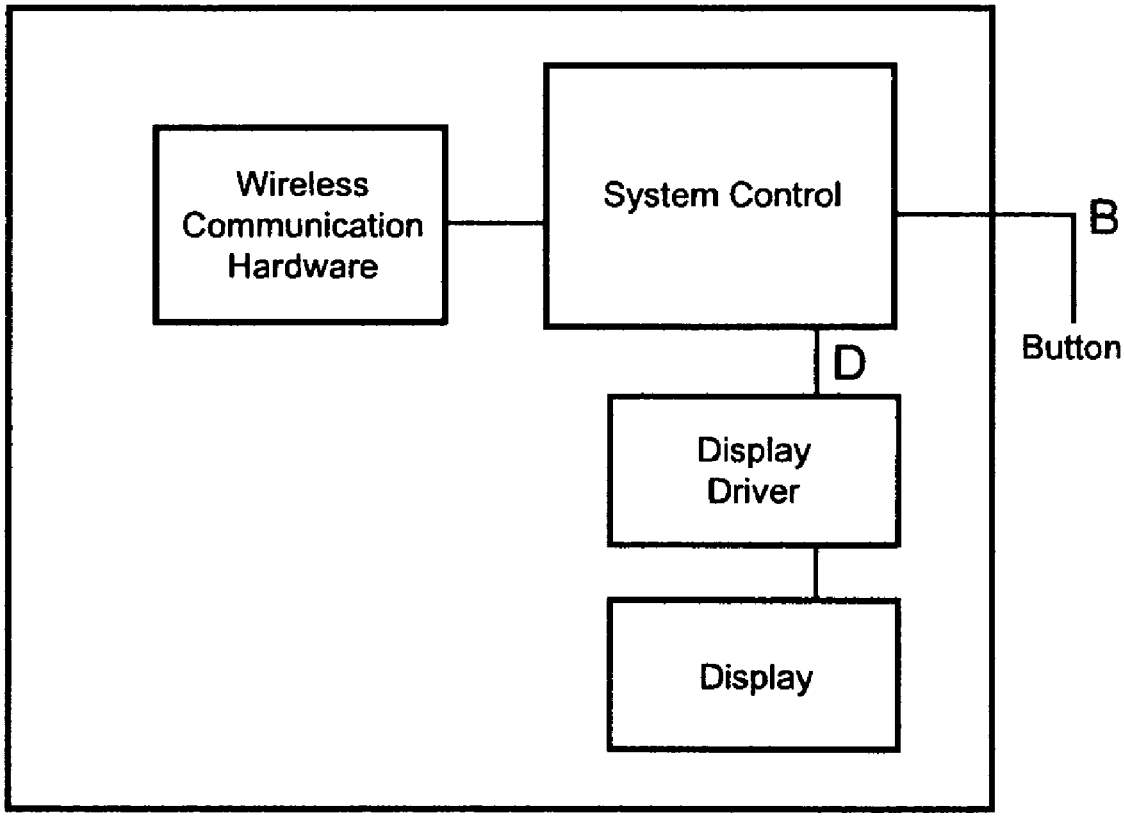

FIG. 4—Block diagram of the circuit for the analysis and feedback unit in the preferred embodiment FIG. 5—Flowchart of the system operation in the preferred embodiment FIG. 6—Perspective view of an alternative embodiment of the system on a urinal without a proximity sensor FIG. 7—Block diagram of the circuit for the analysis and feedback unit in an alternative embodiment of the system on a urinal without a proximity sensor FIG. 8—Perspective view of an alternative embodiment of the system on a urinal with an existing proximity sensor FIG. 9—Block diagram of the circuit for the analysis and feedback unit in an alternative embodiment of the system on a urinal with an existing proximity sensor FIG. 10—Perspective view of an alternative embodiment of the system with a supplemental solar power supply FIG. 11—Block diagram of the circuit for the analysis and feedback unit in an alternative embodiment of the system with a supplemental solar power supply FIG. 12—Perspective view of an alternative embodiment of the system with a multiplicity of targets, an interactive display and an expansion slot FIG. 13—Perspective view of an alternative embodiment with a wireless communication system FIG. 14—Block diagram of the circuit for the sensor and analysis unit in an alternative embodiment with a wireless communication system FIG. 15—Block diagram of the circuit for the feedback unit in an alternative embodiment with a wireless communication system

DRAWINGS—REFERENCE NUMERALS

20—the system
22—the target
24—the sensor
25—the urinal
26—the toilet
27—toilet bowl
28—the toilet bowl interior wall
29—toilet water surface
30—the toilet bowl exterior wall
31—the urinal interior wall
32—analysis and feedback unit for residential toilet
33—analysis and feedback unit button for residential toilet
34—analysis and feedback unit display
35—sensor and analysis unit with wireless circuitry
36—feedback unit with wireless circuitry
37—analysis and feedback unit for commercial urinal with sting proximity detector
38—expansion slot
39—removable memory
40—analysis and feedback unit with solar panel for residential toilet
41—solar panel
42—analysis and feedback unit with proximity detector for commercial urinal
43—the urinal exterior wall
44—the multiple target display
45—the second smaller target
46—the third square target
47—the urinal with existing proximity sensor
48—analysis and feedback unit with multiple target display and expansion slot
50—acoustic sensor
52—foam acoustic sensor housing
54—upper interior of foam acoustic sensor housing
56—dual conductor wire
58—conduit
60—outer rim of foam housing with adhesive
80—dome
83—tabs with adhesive on one side
90—proximity sensor
91—existing proximity sensor
A—signal from acoustic sensor to amplification stage
B—signal from button to processor
C—signal from analog to digital converter to processor
D—signal from processor to display driver
M—signal from proximity sensor to processor
O—signal from amplification circuit to processor

DETAILED DESCRIPTION

The above described drawings illustrate preferred and alternative embodiments of the invention, a toilet entertainment device 20 that is comprised of a target 22 and a sensor 24 connected by a wire 56 to an analysis and feedback unit 32. The toilet entertainment device 20 is mounted on a toilet 26. The invention will feedback the properties of the stream of urine via a score based on pressure, duration and accuracy of the urine stream.

DESCRIPTION—FIGS. 1–5—PREFERRED EMBODIMENTS

The preferred embodiment of a toilet entertainment device 20 is illustrated in FIG. 1 (perspective view) and FIG. 4 (system block diagram). A simple semi-permanent, disposable target 22 is mounted in a toilet 26 on toilet bowl interior wall 28 above toilet water surface 29. A sensor 24 is mounted on toilet exterior wall 30. Sensor 24 includes an acoustic sensor or microphone 50 with the diaphragm of acoustic sensor 50 facing toilet exterior wall 30. When a user directs a stream of urine at target 22, the unique sound of the urine stream upon target 22 is detected by acoustic sensor 50 and processed by an analysis and feedback unit 32. This acoustic method of urine stream analysis allows simple, clean installation of the target without wires in toilet bowl 27, wires along toilet bowl interior wall 28 or modifications such as drilling to toilet bowl 27. Cleaning is simplified when electronics are not directly exposed to toilet bowl interior wall 28, where the most vigorous cleaning occurs.

A signal A (FIG. 4) from acoustic sensor 50 propagates through a dual conductor wire 56 into an analysis and feedback unit 32. Analysis and feedback unit 32 determines via audio analysis of signal A if the user is accurately hitting target 22 with a stream of urine. Analysis and feedback unit 32 includes a display 34 which will feedback a score to the user. Analysis and feedback unit 32 increases the score for higher urine stream pressure and longer urine stream duration as long as the urine stream accurately hits target 22.

FIG. 3 illustrates the preferred embodiment of target 22. In the preferred embodiment, target 22 is a dome 80 formed from an inexpensive plastic. In the preferred embodiment, the manufacturing process used to produce halves of ping-pong balls would be adapted to produce dome 80 with a multiplicity of flexible plastic tabs 83 on the edge of dome 80.

In the preferred embodiment shown in FIG. 3 there is an adhesive coating on plastic tabs 83. In the preferred embodiment the adhesive coating is that used for surfboard deck-grip. In other embodiments, the adhesive coating is chosen by one skilled in the art to readily adhere to the clean, dry interior toilet surface 28 and to maintain adhesion between plastic tabs 83 and toilet interior wall 28 in the presence of impacts from solids or liquids on and around target 22. The adhesive coating is protected by a peel-away cover. After removal of the peel-away cover, the adhesive surface is exposed and can be easily attached to the clean, dry interior toilet surface 28.

In the preferred embodiment target 22 may have a printed, embossed or etched logo or picture visible to the user to serve as further encouragement to the user to aim their urine stream at target 22. After the picture on target 22 has worn off, the adhesion of target 22 to interior toilet wall 28 is beginning to fail, or the user has deemed target 22 an otherwise unworthy recipient of his or her stream of urine, it may be pried off with a flat edged metal tool such as a screwdriver and flushed down toilet 26 or thrown away. A new target 22 can be selected by the user to replace the removed target.

Alternative embodiments of the shape of the target include a flat sticker, a recess in interior toilet wall 28 or a shape designed by one skilled in the art such that the stream of urine will not deflect outside of bowl 27 upon striking target 22. Other alternative embodiments of target 22 use foam, rubber or any other material which, when contacted with a urine stream, has a characteristic spectral range or sonic signature in which sound frequencies with maximum energy lie that is different from the sonic signature of urine contacting toilet interior wall 28. In other alternative embodiments, target 22 may be affixed to interior toilet wall 28 with hook-and-loop fasteners, suction cups or mechanical structures placed in bowl 27 which stabilize target 22.

FIG. 2 illustrates the preferred embodiment of sensor 24. Acoustic sensor 50 is used in sensor 24. Acoustic sensor 50 is contained within a foam housing 52. The acoustic sensor 50 also has dual conductor wire 56 leading from acoustic sensor 50 to analysis and feedback unit 32. Foam housing 52 contains a conduit 58 for dual conductor wire 56. The outer rim of foam housing 60 has an adhesive coating. The adhesive coating on the outer rim of the foam housing 60 adheres to toilet bowl exterior wall 30. The adhesive coating has a protective peel-away cover. Upon removal of the peel-away cover, the adhesive surface is exposed and can be easily attached to the clean, dry toilet bowl exterior wall 30. The adhesive coating is selected by one skilled in the art so as to maintain a lasting adhesion between foam housing 52 and toilet exterior wall 30 so as not to be affected by cleaning or impacts from solids or liquids on and around sensor 24. In one embodiment the adhesive coating is that used for surfboard deckgrip. The properties of the adhesive coating are such that, when installed on a clean dry surface they withstand moisture and physical contact.

In the preferred embodiment acoustic sensor 50 is sandwiched between upper interior of the foam housing 54 and toilet bowl exterior wall 30. The close proximity of acoustic sensor 50 to toilet bowl exterior wall 30 allows for the sound transferred through toilet 26 to reach acoustic sensor 50 with minimal dissipation. Foam housing 52 combined with the close proximity of acoustic sensor 50 to toilet exterior wall 30 helps keep noise such as yelling or footsteps from influencing signal A.

In FIG. 1 toilet entertainment device 20 has analysis and feedback unit 32. The wire 56 transmits signal A from sensor 24 to analysis and feedback unit 32. Feedback is generated in the form of audio and/or visual feedback generated by analysis and feedback unit 32.

The block diagram in FIG. 4 represents analysis and feedback unit 32. Dual conductor wire 56 carries signal A from acoustic sensor 50 into analysis and feedback unit 32. Signal A is the input into an operational amplifier or amplification stage inside analysis and feedback unit 32. The electrical values of the circuitry in the amplification stage and the components required for biasing the amplification stage are determined by one skilled in the art. The amplification stage output signal O feeds into the analog input of an analog to digital or a/d converter. The digital output signal C of the a/d converter enters a digital signal processor or DSP. A user accessible button or switch 33 mounted on the exterior of the analysis and feedback unit 32 feeds a signal B into the DSP. The DSP outputs a signal D. The signal D feeds into a display driver. The display driver controls a liquid crystal display or LCD. The LCD or display 34 is mounted on the exterior of analysis and feedback unit 32. Display 34 is for user feedback. The output indicates a positive result when target 22 is contacted with a stream of urine. The result is unchanged or negative when the stream of urine contacts the water or a part of toilet 26 where target 22 is not located.

In alternative embodiments (not shown) the output from the DSP is displayed visually, audibly, or with any other device necessary to indicate the level of success achieved by the user in connecting their stream of urine to target 22.

In the preferred embodiment of FIG. 4 electrical power for all components in analysis and feedback unit 32 is provided by four AA batteries.

DESCRIPTION—FIGS. 6–15—ALTERNATIVE EMBODIMENTS

An alternative embodiment in FIG. 10 employs a solar panel 41 mounted to the exterior of an analysis and feedback unit 40. Solar panel 41 provides power to allow analysis and feedback unit 40 to constantly monitor acoustic sensor 24 for a new user after toilet 26 has been flushed. The use of solar power extends battery life. FIG. 11 shows the block diagram of analysis and feedback unit 40. The solar panel, batteries, and other functional blocks interact with a power management system, designed by one skilled in art, to ensure solar power is efficiently distributed to batteries for charging and to other functional blocks for routine system operation. An alternative embodiment (not shown) designed by one skilled in the art employs existing residential or commercial power sources or a power supply already existing on a toilet or urinal.

In an alternative embodiment mounted on a urinal 25 in FIG. 6, an analysis and feedback unit 42 includes a motion or proximity sensor module 90 to detect the presence of a user in front of analysis and feedback unit 42. The purpose of proximity sensor 90 is to allow the DSP (FIG. 7) to reset the score and initiate a new game upon detection of a new user. In this embodiment (FIG. 6) dual conductor wire 56 runs, hidden from view, behind the water pipes and valves of urinal 25 to connect analysis and feedback unit 42 and sensor 24. Sensor 24 is mounted on the side or back of urinal exterior wall 43 and target 22 is mounted on the urinal interior wall 31. In the block diagram FIG. 7 of this alternative embodiment, proximity sensor module 90 interfaces directly with the DSP. The sensor can be designed by one skilled in the art to detect the user when the user approaches or departs the area around the toilet. In an alternative embodiment (not shown) analysis and feedback unit 42 contains a sensor that detects a user entering the toilet area when the user switches on the lights.

An alternative embodiment in FIG. 8 shows a urinal 47 with a motion or proximity sensor 91 used in a system to flush urinal 47 when the user departs. Installed directly above or below proximity sensor 91 is an analysis and feedback unit 37. In FIG. 9 the block diagram of analysis and feedback unit 37 includes an input for the proximity sensor's signal M. This signal M is used in proximity sensor 91 to trigger flushing of urinal 47 when the user departs. One skilled in the art can use signal M from proximity sensor 91 as an input to analysis and feedback unit 37. The signal M will be used by the DSP in analysis and feedback unit 37 to detect a new user and initialize the system for a new game sequence.

An alternative embodiment FIG. 13 is envisioned that would utilize wireless technology to transmit digital data from a sensor 35 to a feedback unit 36. The block diagram in FIG. 14 shows an amplification stage, analog to digital conversion, processing, and wireless hardware in the housing of the sensor 35. A block diagram in FIG. 15 indicates additional processing and wireless hardware in the feedback unit 36. The wireless technology would remove the need for a wire to carry an electrical signal from the sensor to the feedback method. In alternative embodiments all analysis hardware is contained in feedback unit 36.

An alternative embodiment in FIG. 12 has multiple targets, each producing a different sound when struck by a stream of urine. This embodiment is shown with a target 22, a smaller target 45 and a square target 46. A multiple target display 44 provides a feedback that encourages the user to aim the urine stream at a specific target.

In FIG. 12 an expansion slot 38 in the analysis and feedback unit 48 contains a portable media device 39 such as a flash memory card or other removable memory containing data to change the entertainment program, education program, game program or personalize the analysis or feedback parameters for a given user or plurality of users. For example, in FIG. 12 analysis and feedback unit 48 is initially loaded with a game in which the user shoots ducks by aiming a urine stream at the correct target as directed by display 44. In this embodiment, the user has the option of inserting removable memory 39 into expansion slot 38. In this embodiment, removable memory 39 allows the user to play a different game, with, for example, a space ship that dodges asteroids by jumping to areas corresponding to the target contacted by the urine stream. In another removable memory, the user may store personal preferences regarding analysis and feedback parameters such as background color used on the display or the sensitivity of the algorithm detecting the loudness of a urine stream upon the target.

An alternative embodiment (not shown) is envisioned in a facility with multiple urinals or toilets with the invention located at each toilet or urinal. In this embodiment the analysis and feedback units for each toilet or urinal would be linked with a communications system so in the case of multiple users, the display would feedback the status and score of each user on all displays in order to stimulate competition among users.

OPERATION—FIGS. 1,4,5—PREFERRED EMBODIMENTS

In the preferred embodiment (FIG. 1) the user's urine stream impacts the interior toilet wall 28, the surface of target 22 or the surface of the toilet water 29. A different sound is generated when a liquid or urine stream contacts each of these surfaces. Sensor 24, containing acoustic sensor 50, detects the sound generated by urine striking the various surfaces, background noise in the vicinity of the toilet and sounds associated with the flushing of the toilet 26. Dual conductor wire 56 connecting acoustic sensor 50 to analysis and feedback unit 32 carries the electrical signal A (FIG. 4) representing the sound into the amplification stage. One skilled in the art can bias the amplification stage to generate an output signal O appropriate for input into the a/d converter. The digital output signal C generated by the a/d converter enters the Digital Signal Processor or DSP.

The signal C is a digital representation of the sound sensed by acoustic sensor 50. The DSP is programmed by one skilled in the art to sample signal C and compare it to reference sounds collected during calibration. The DSP program algorithm only reacts to pre-calibrated sounds. The DSP program ignores background noise and other sounds that don't match those collected during calibration. Background noises such as footsteps, lifting of the toilet seat, talking or yelling may share some frequency components with pre-calibrated sounds, but will not share all frequencies or contain the same pattern of average frequencies over time. This comparison will prevent unwanted noises from affecting the feedback displayed to the user.

In the preferred embodiment, the DSP generates an output signal D that feeds into a display driver. The display driver creates and changes images on the display 34. The display 34 shows a numerical score during regular operation. The score increases quickly with a strong and loud stream of urine upon target 22. The score increases at a slower rate with a weak and quieter stream of urine upon target 22. The score will be saved and, if within the top 10 scores, will be included in a leaders' list.

OPERATION OF DSP PROGRAM FLOW—FIG. 5—PREFERRED EMBODIMENT

The audio analysis program represented by the flowchart in FIG. 5 is the DSP program flow used to analyze the input signal, determine the level of performance and display an output to the user. The flow is divided into a calibration flow and a game flow.

When the unit is first installed on toilet 26 and power is applied to analysis and feedback unit 32 the DSP will poll a nonvolatile memory bit named calibration_complete. The calibration_complete bit indicates if analysis and feedback unit 32 has completed a full calibration. If analysis and feedback unit 32 has not previously been calibrated, the DSP will enter a user interactive calibration mode.

The calibration mode will begin by prompting the user to depress button 33 on analysis and feedback unit 32 when the user is ready to aim a water stream at target 22. The characteristics of the water stream are chosen to duplicate the characteristics of a user's stream of urine. The preferred embodiment of the method for duplicating a urine stream is a six ounce water bottle with a nozzle size and shape chosen by one skilled in the art to emulate a stream of urine when water passes through it. After depressing button 33, the user will shoot the water stream at target 22. In the preferred embodiment the DSP is programmed by one skilled in the art to use a Fast Fourier Transform or FFT optimized to detect a pattern in the audio frequencies with maximum energy or sonic signature of the sound created when the water stream contacts target 22. Assuming an audio frequency range of 50–10000 Hz, sampling would need to occur at a rate of 20000 Hz to prevent aliasing. To implement the FFT with a resolution of 50 Hz, a 512-point FFT can be used. Upon completion of the FFT, the frequency components are saved to a nonvolatile memory location on the DSP or connected to the DSP.

Next, the calibration mode will prompt the user to depress button 33 on analysis and feedback unit 32 when ready to aim a water stream at the toilet's interior wall 28. At this point, the DSP uses an FFT optimized to detect the sonic signature of the sound created when the water stream contacts the toilet's interior wall 28. The frequency components are saved to a nonvolatile memory location.

Next, the calibration mode will prompt the user to depress button 33 when ready to aim a water stream at the toilet bowl water surface 29. Again, the DSP uses the FFT algorithm to detect the sonic signature of the sound created when the water stream contacts the toilet bowl water surface 29. The frequency components are saved to a nonvolatile memory location.

Finally, the calibration mode will prompt the user to depress button 33 when ready to flush toilet 26. The DSP detects the sonic signature-created with the sound of flushing water. The frequency components are saved to a nonvolatile memory location. With the frequency sampling complete the calibration_complete bit is set and the DSP enters Game Mode. Upon the next power up or reset the DSP will poll the calibration_complete bit, determine the calibration is finished and enter the Game Mode. Should the user wish to recalibrate the toilet entertainment system 20, possibly because of relocation of the system 20 or replacement of the target 22, the DSP will reenter calibration mode, via an interrupt, when the user depresses button 33 for three seconds.

The first step in game mode is detection of the user. In the preferred embodiment in FIG. 1, analysis and feedback unit 32 is actively monitoring acoustic sensor 50 at all times. In the flowchart in FIG. 5, when a user begins urinating into toilet bowl 27, analysis and feedback unit 32 will detect the user by sensing the sound of the impact of the urine stream upon target 22, the toilet bowl interior wall 28, or the toilet bowl water surface 29. In alternative embodiments the user will depress button 33 to signal their presence. The DSP is programmed to clear the score to zero after detection of the user.

Next, the DSP is programmed by one skilled in the art to use the FFT algorithm to detect a pattern in the sonic signature of urine striking target 22. The DSP will increase the score if it matches the primary frequency components of signal C to those saved in nonvolatile memory during calibration of target 22. The DSP will leave the score unchanged if it matches the primary frequency components of signal C to those saved in nonvolatile memory during calibration of the toilet bowl interior wall 28, the toilet bowl water surface 29 or background noise. The DSP will be programmed by one skilled in the art to update the score to display 33 or in alternative embodiments, to any other feedback device. After updating the score, the DSP will allow 0.25 seconds to elapse before sampling sensor 24 again.

The DSP will stop the current game session if the sound of the flushing toilet 26 is detected by sensor 24. Additionally, if, for 10 seconds, the DSP does not detect the sonic signatures created by the sound of urine striking the target 22, the toilet bowl interior wall 28, or the toilet bowl water surface 29, the DSP will stop the current game session. After a game session has stopped the DSP will continue to output the score on the display 33 for the next user to view. This will offer the next user a competitive score to match or exceed. Alternately, the DSP may alternate between the last score and a listing of the top 10 scores leaders.

OPERATION—FIGS. 6,8,10,12,13—ALTERNATIVE EMBODIMENTS

Alternative embodiments in FIG. 6 and FIG. 8 are envisioned that utilize a motion sensor connected to the analysis and feedback unit. The motion sensor is designed by one skilled in the art to detect the user's presence in front of urinal 25 or urinal 47. This embodiment would preserve battery power and allow analysis and feedback unit 37 in FIG. 8 and analysis and feedback unit 42 in FIG. 6 to operate longer on a given set of batteries.

An alternative embodiment FIG. 10 is envisioned utilizing solar panel 41 mounted on analysis and feedback unit 40. This embodiment would allow the DSP to constantly monitor the sensor for sound without drawing as much battery power and allow analysis and feedback unit 40 to operate longer on a given set of batteries. This embodiment would require analysis and feedback unit 40 to be placed under a window or skylight to allow sun to shine on the solar panel.

An alternative embodiment in FIG. 12 uses a multiplicity of targets 22, 45, and 46. Each target, owing to its different shape, size, or material composition, produces a different sound when struck by a stream of urine. During calibration, each target must be calibrated separately. In this alternative embodiment, the user will attempt to aim the urine stream at the specific target 22, 45, or 46 as directed by analysis and feedback unit 48. After correctly contacting the target, analysis and feedback unit 48 will increase the score and change the image to direct the user to a different target. In alternative embodiments, a moving image will appear on a display 44. The image will move into different sections of display 44. Each section is represented by target 22, 45, or 46. The user will attempt to hit the moving image by aiming the urine stream at the target corresponding to section containing the moving image. The score will be increased each time the user hits the correct target.

In FIG. 12 an expansion slot 38 is provided in analysis and feedback unit 48. When the user inserts a removable memory 39 into expansion slot 38 the DSP will interact with a system designed to read data from removable memory 39. When the DSP processes removable memory 39 data, it will change parameters or games according to the data on removable memory 39. Removable memory 39 may contain data that changes the type of game available to the user, the user's personal settings for display parameters such as background color or high scores or the user's personal settings for analysis parameters such as acoustic sensitivity. In the case of acoustic sensitivity, the user may wish to change the sensitivity of the algorithm detecting the sonic signature to compensate for an unusually strong or weak urine stream. Upon removal of removable memory 39 from expansion slot 38 analysis and feedback unit 48 will return to its state before the insertion of removable memory 39.

It is envisioned that features from one embodiment could be added to another embodiment. For instance, the wireless system embodied in FIG. 13 could be adapted for use in the urinal and proximity sensor embodiment in FIG. 6. One skilled in the art could envision other embodiments not detailed in the specification. The scope of the invention is to be interpreted only in conjunction with the appended claims.

CONCLUSIONS, RAMIFICATIONS AND SCOPE

This method of sensing a urine stream using an acoustic sensor mounted on the exterior of a toilet bowl is fun to use for the purposes of entertainment and toilet training education. It is easily installed on any toilet or urinal with minimal changes to cleaning routines after installation. Furthermore, it is envisioned the invention could be easily adapted to the carnival water gun accuracy game, a fun system to use when milking a cow, or any other use involving liquid flow onto a surface. It will scale for industrial uses involving monitoring the transfer of liquid or other flowing materials.

The target can be customized by the user using a waterproof pen. The user would be able to place logos, pictures or words that encourage or discourage aiming a stream of urine at the target. Furthermore, a sheet of material could be inserted in a computer printer and, with the proper software the user would create targets on a PC for placement in the toilet or urinal.

Although the specification above contains multiple specificities, these should not be construed as limiting the scope of the invention, but as merely providing illustrations of some of the presently preferred embodiments of the invention. The scope of the invention should be determined by the appended claims and their legal equivalents, rather than examples given.

We claim:

1. An entertainment device for use with a toilet or a urinal comprising:

a) a target for mounting within a toilet bowl or the urinal and is constructed such that, when struck by a liquid stream, said target creates an audible sound that is different when compared to the audible sound created when said liquid stream strikes a toilet bowl surface or a urinal surface, b) an acoustic sensor which converts said audible sounds into an electrical signal, said sensor is positioned on said toilet where the sensor is protected from substantial moisture and friction, c) means of analysis to analyze said electrical signal, d) means of feedback to provide a feedback to a user, e) means of transmitting said electrical signal from said sensor to said analysis means, f) means of transmitting an output signal from the means of analysis to said means of feedback, and g) a power supply, whereby said means of analysis responds to the electrical signal and said means of analysis transmits said output signal to said means of feedback and the means of feedback provides said feedback to said user in response to the impact of said liquid stream on said target and said surface of said toilet or urinal.

2. The entertainment device of claim 1 wherein said target is made of plastic.

3. The entertainment device of claim 1 wherein said sensor is comprised of a microphone.

4. The entertainment device of claim 1 wherein said means of analysis comprise:

a) a signal amplification stage, b) an analog to digital converter, and c) a digital signal processor.

5. The entertainment device of claim 1 wherein the means of feedback comprise:

a) a processor, b) a display driver, and c) a liquid crystal display.

6. The entertainment device of claim 1 wherein the power supply of said means of analysis and said means of feedback consists of a device selected from the group consisting of batteries, solar panels, fuel cells, and a means of connecting to external power supplies.

7. The entertainment device of claim 1 wherein said sensor and said means of analysis and said means of feedback comprise a means for a wireless data communications system to transmit a signal from said sensor to the group consisting of said means of analysis and said means of feedback.

8. The entertainment device of claim 1 further comprises a user detection device selected from the group consisting of a means for proximity detection, a means for light detection and a means for sound detection.

9. The entertainment device of claim 1 wherein there exists a plurality of said targets such that each target when struck by said liquid stream creates a sound with a sonic signature that is substantially different when compared to the sonic signature of the sound created by said liquid stream striking another said target.

10. The entertainment device of claim 1 wherein the feedback means is an audio means producing an audible signal when activated.

11. The entertainment device of claim 1 wherein the feedback means is a visual means producing a visible signal when activated.

12. The entertainment device of claim 1 wherein there exists a plurality of said entertainment devices whereby said feedback from said entertainment device is compared to the feedback from a second entertainment device.

13. The entertainment device of claim 1, wherein said means of analysis comprises a removable memory containing data unique to the means of analysis.

14. The entertainment device of claim 1, wherein said means of feedback comprises a removable memory containing data unique to the means of feedback.

15. The entertainment device of claim 1, wherein said means of analysis and said means of feedback are located inside a housing.

16. A method of entertaining a user of a urinal, the method comprising the steps of:

a) providing an entertainment device for use with the urinal comprising:

a target for mounting within the urinal and is constructed such that, when struck by a liquid stream, said target creates a sound with a sonic signature that is different than a sonic signature of a sound created when said liquid stream strikes the urinal, an adhesive on the base of said target to attach said target within said urinal, a microphone that converts said sound into an electrical signal, said microphone is situated on the exterior of said urinal where said microphone is protected from substantial moisture and friction, an adhesive on an outer rim of a diaphragm cover of said microphone to attach said microphone to the exterior of said urinal, an analysis and feedback unit to analyze said electronic signals and provide a feedback to a user, the analysis and feedback unit comprising:

a) a signal amplification stage, b) an analog to digital converter, c) a processor, d) a display driver, and e) a liquid crystal display, a housing for said analysis and feedback unit with said housing adapted to position said analysis and feedback unit in the view of said user, and a wire to connect said sensor to said analysis and feedback unit, b) directing said liquid stream against the wall of said urinal, c) converting the sound of the impact of said liquid stream against the wall of said urinal into an electric signal with said microphone for transferring by said wire into said analysis and feedback unit, d) amplifying said electrical signal with said signal amplification stage for transferring to the analog to digital converter, e) converting the amplified representation of said electric signal with said analog to digital converter into a digital signal for transferring to the processor, f) comparing said digital signal to a reference digital signal that is recorded from the sound of the impact of said liquid stream upon said target to calculate the success of said user in impacting said liquid stream upon said target, g) displaying on said liquid crystal display a representation of the success of said user in impacting said liquid stream upon said target, whereby said analysis and feedback unit provides entertainment to said user in response to the impact of said liquid stream on said target and the urinal.

17. A method of communicating information about the impact of a liquid stream of material upon a surface of a toilet or a urinal, the method comprising the steps of:

a) providing a device for use with the surface comprising:

a target for mounting within a toilet bowl or the urinal and is constructed such that, when struck by a liquid stream, said target creates a sound with a sonic signature that is substantially different than a sonic signature of a sound created when said liquid stream strikes the surface of the toilet or the urinal on which said target is located, an acoustic sensor which converts said sound into an electrical signal, said acoustic sensor is situated on the exterior of the toilet and urinal where said acoustic sensor is protected from substantial moisture and friction, an analysis and feedback unit to analyze said electrical signal and provide a feedback to a user, the analysis and feedback unit comprising:

a) a signal amplification stage, b) an analog to digital converter, c) a processor, and d) a means of output, a housing for said analysis and feedback unit, and a means to connect said sensor to said analysis and feedback unit, b) directing said liquid stream onto said surface of the toilet or the urinal, c) converting the sound of the impact of said liquid stream onto said surface with said acoustic sensor into said electrical signal for transferring to said analysis and feedback unit by said means to connect said sensor to said analysis and feedback unit, d) converting said electrical signal into a digital signal, e) comparing said digital signal with a reference digital signal that is recorded from the sound of the impact of the liquid stream upon said target to calculate the quantity of said liquid stream impacting said target, and f) producing a signal indicating the quantity of said liquid stream impacting said target, whereby said analysis and feedback unit provides an output in response to the impact of said liquid stream on said target and surface.

18. The method of claim 17 wherein the means to connect said sensor to said analysis and feedback unit is a dual conductor wire.

19. The method of claim 17 wherein the means to connect said sensor to said analysis and feedback unit is an electronic wireless data transmission system.

20. The method of claim 17, wherein the analysis and feedback unit comprises a removable memory for storing data unique to the analysis and feedback unit.

* * * * *